US006585488B1

(12) United States Patent
Bucher et al.

(10) Patent No.: US 6,585,488 B1
(45) Date of Patent: Jul. 1, 2003

(54) CEILING FAN BLADE ISOLATION SYSTEM

(75) Inventors: John C. Bucher, Ft. Lauderdale; Charles E. Bucher, Valrico, both of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/513,772

(22) Filed: Feb. 25, 2000

(51) Int. Cl.[7] ..... F04D 29/34
(52) U.S. Cl. ..... 416/210 R; 416/244 R
(58) Field of Search ..... 416/5, 210 R, 416/204 R, 244 R

(56) References Cited

U.S. PATENT DOCUMENTS

| | | | | | |
|---|---|---|---|---|---|
| 1,935,314 | A | | 11/1933 | Finch et al. | 170/162 |
| 4,511,310 | A | | 4/1985 | Pearce | 416/134 R |
| 4,621,977 | A | | 11/1986 | Markwardt | 416/5 |
| 4,720,241 | A | | 1/1988 | Markwardt | 416/5 |
| 4,850,799 | A | | 7/1989 | Bucher, Sr. et al. | 416/134 R |
| 5,304,037 | A | | 4/1994 | Scofield | 416/134 R |
| 5,464,323 | A | | 11/1995 | Scofield | 416/134 R |
| 5,722,814 | A | * | 3/1998 | Yu | 416/204 R |
| 6,039,540 | A | * | 3/2000 | Wu | 416/210 R |
| 6,210,117 | B1 | * | 3/2001 | Bucher et al. | 416/210 R |

* cited by examiner

*Primary Examiner*—Edward K. Look
*Assistant Examiner*—Ninh Nguyen

(57) ABSTRACT

A ceiling fan comprising a plurality of fan blades connected to a rotatable motor by respective fan blade brackets with the fan blades being connected to the respective fan blade brackets by means of a boss that receives the fastener and a washer having a hole positioned around the boss between the fan blade bracket and the fan blade, whereby the washer may be affixed into position about the boss prior to installation of the fastener.

12 Claims, 5 Drawing Sheets

CEILING FAN BLADE ISOLATION SYSTEM

BACKGROUND OF THE INVENTION

1. Field of the Invention

This invention relates to ceiling fans. More particularly, this invention relates to vibration dampers for ceiling fans.

2. Description of the Background Art

Motor driven fans suspended from the ceiling were used extensively in homes in the United States to provide air circulation before the introduction and popularization of central cooling units.

When the energy crisis dawned in the 1970's, the cost of a kilowatt hour sky rocketed in price and consumers searched for ways to reduce their heating and cooling costs. It has been well established that properly circulated air will raise the overall thermal efficiency of the home air conditioning and cooling system and hence, reduce the cost of maintaining a home at a desired comfort level year round. Thus, ceiling fans were re-popularized in the 1970's.

Mass produced, low cost ceiling fans have several disadvantages that must be tolerated in return for savings in energy. The lower cost fans are typically noisy and vibrate excessively and the blades visibly sway. The noise and vibration are largely caused by pulsating torques common to all single phase AC motors.

Ceiling fans typically comprise a plurality of fan blades which are rigidly connected to the rotor of an electric motor by means of fan blade brackets integrally formed with or threadably fastened to the blades. In some ceiling fans, the inner rotor rotates within the outer stator of the electric motor as exemplified in U.S. Pat. No. 1,935,314. In other types of ceiling fans, commonly known as "spinner" fans, the rotor constitutes the outer housing of the fan and rotates about the inner stator. U.S. Pat. Nos. 4,621,977 and 4,720,241 disclose such spinner-type fans.

Previous attempts to reduce the noise and vibration originally focused on placing elastomeric grommets about the threaded fasteners which innerconnect the fan blades to their respective fan blade brackets. U.S. Pat. Nos. 5,304,037 and 5,464,323, the disclosures of which are hereby incorporated by reference herein, disclose the use of elastomeric grommets. Similar attempts have also focused on attaching all of the fan blade brackets to a mounting ring and then threadably securing the mounting ring to the rotor through the use of threaded fasteners positioned through elastomeric grommets. U.S. Pat. No. 4,511,310, the disclosure of which is hereby incorporated by reference herein, illustrates the latter embodiment. In both embodiments, the threaded fastener comprises a bolt having a shank portion greater in length than the thickness of the grommet such that the shank prevents compression of the grommet upon tightening of the bolt. Thus, the grommet is freely suspended between the head of the bolt and the rotor. More modem elastomeric rings have been employed such as those disclosed in U.S. Pat. Nos. 4,850,799 and 4,511,310, the disclosures of which are hereby incorporated by reference herein.

The use of elastomeric grommets between the fan blades and the fan blade brackets or between the rotor and a mounting ring to which the fan blades are rigidly connected, have both been favorably accepted in the industry. Notwithstanding, the fan blades may "wobble" since the resiliency provided by the freely suspended elastomeric grommets is essentially the same for torsional, axial, and radial forces. Moreover, the elastomeric grommets are difficult to assemble by the do-it-yourself handyman, and are sometimes lost during assembly, thereby resulting in the entire ceiling fan being returned to the store for credit.

Therefore, it is an object of this invention to provide an apparatus which overcomes the aforementioned inadequacies of the prior art devices and provides an improvement which is a significant contribution to the advancement of the ceiling fan vibration damper art.

Another object of this invention is to provide vibration washers for ceiling and other fans which provides torsional damping to dampen the pulsating torque created by single phase electric motors.

Another object of this invention is to provide vibration washers for ceiling and other fans for torsionally damping pulsating torques while minimizing radial and axial movements.

Another object of this invention is to provide vibration washers for ceiling and other fans which may be easily incorporated in existing fan constructions during the manufacture thereof thereby reducing the likelihood that the consumer will misplace the washers during assembly and installation of the ceiling fan.

Another object of this invention is to provide a vibration damper for ceiling and other fans which does not adversely effect the aesthetic appearance of the fan.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises vibration washers for ceiling and other fans. More particularly, the vibration washers of the invention interconnect the fan blades with the fan brackets to dampen the pulsating vibrations caused by the electric motor thereby minimizing such vibrations from being transmitted to the fan blades.

The vibration washer of the invention may comprise several embodiments. The principle configuration of the vibration washer of the invention comprises a generally flat annular configuration having a center hole for receiving an upstanding boss extending from the fan blade bracket. The diameter of the hole in the washer is preferably dimensioned so as to be press-fitted over the washer so that it can be installed over the washer at the factory and not be removed from the washer except by significant intentional effort. The washer is seated upon an annular stepped rim portion formed about the boss. During assembly, the ceiling fan blade is positioned over the boss and is secured to the boss by means of a large-headed fastener. In this regard, it is noted that the combined thickness of the washer and the fan blade is slightly greater than the distance between the upper surface of the annular rim portion and the upper surface of the boss such that the washer undergoes a certain amount of compression as the fastener is threaded into the boss. Upon compression, the fan blade is significantly isolated from vibrations due to the elastomeric qualities of the washer.

As noted above, the washer is press-fitted onto the boss during manufacture. In addition to or in lieu of such press-fitting, the vibration washer of the invention may comprise an annular configuration with an inner, central outer depending skirt that fits either into a recess formed in the upstanding boss or around the periphery of the upstanding boss, respectively, of a ceiling fan blade bracket. The skirt of the washer is configured and dimensioned such that it may be press-fitted into the recess of the boss in the case of an inner or central skirt or around the periphery of the boss in the case of an outer skirt during assembly at the factory. The skirt may be annular in configuration or may simply comprise one or more protrusions that fit into the one or more recesses.

In each embodiment, when the ceiling fan is purchased by a consumer for home installation, the washers of the invention are preferably already factory-installed onto the bosses of the fan blade brackets and the only assembly that is required for the fan blades is to screw each of the fan blades to a respective fan blade bracket. The risk of loosing one of the washers during assembly as in the case of the prior art, is therefore precluded.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
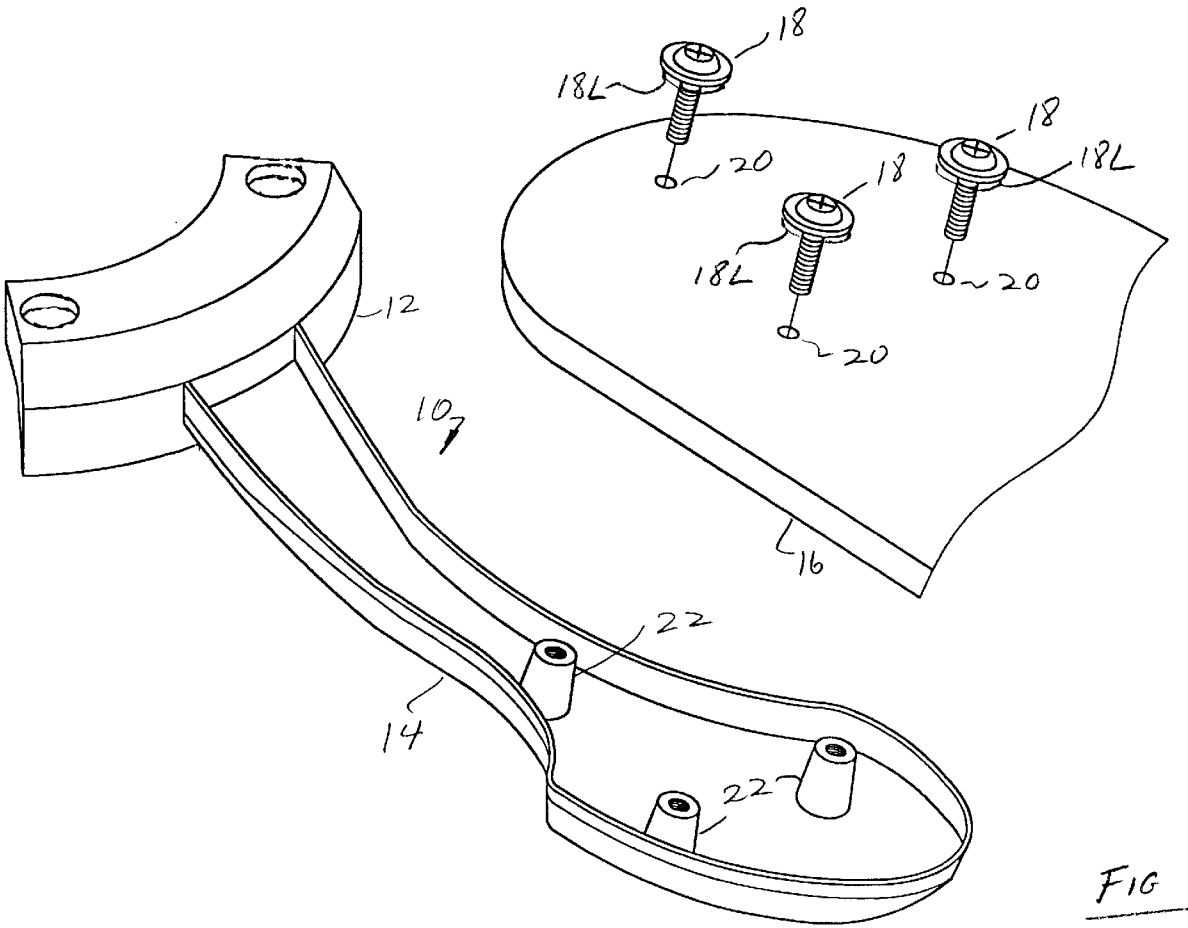
FIG 1 (PRIOR ART)
FIG. 1 is an exploded view of a typical prior art ceiling fan bracket showing the manner in which a fan blade is connected to the upstanding bosses of the fan blade bracket by means of large-headed threaded fasteners.

Referring to FIG. 1, a prior art ceiling fan bracket 10 typically comprises a base portion 12 for connection to a rotating rotor of a motor of a ceiling fan (not shown). The ceiling fan bracket 10 further typically comprises an arm blade portion 14 to which is connected a ceiling fan blade 16 by means of a plurality of large-headed threaded fasteners 18 that are inserted into corresponding holes 20 formed in the blade 16 and threadably engage threaded bosses 22, respectively. Lock washers 18L are typically used with the fasteners 18 to prevent loosening.

Figure 2:
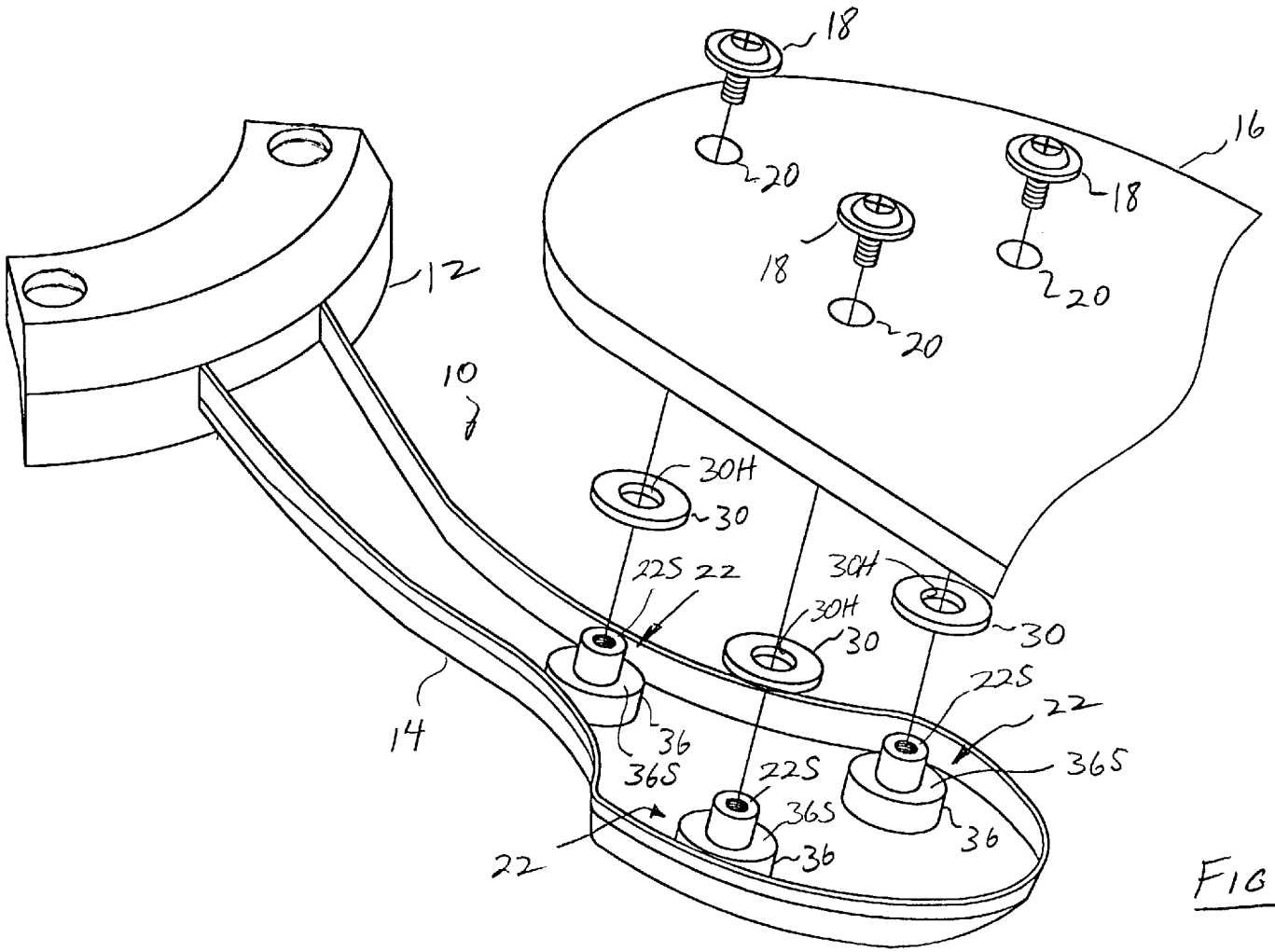
FIG. 2 is an exploded view of a typical ceiling fan bracket showing the manner in which the vibration washer of the invention innerconnects the fan blade brackets to the fan blades.
Figure 3:
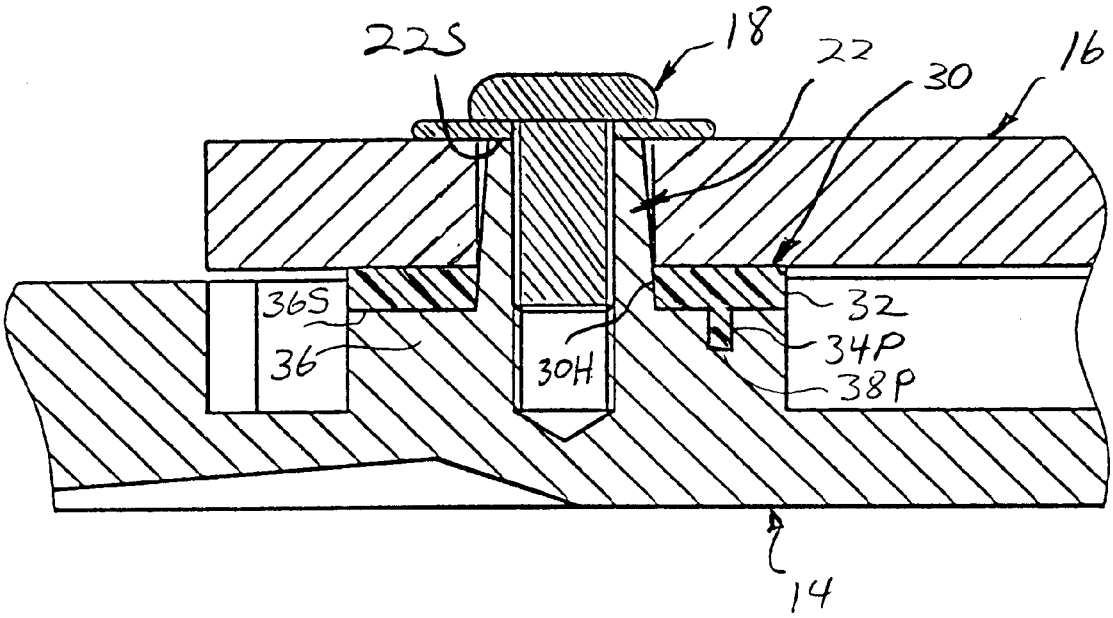
FIG. 3 is a cross-sectional view of a fan blade bracket having the washer of the invention installed therein and with the fan blade connected thereto showing the compression of the washer by the fan blade.
Figure 4:
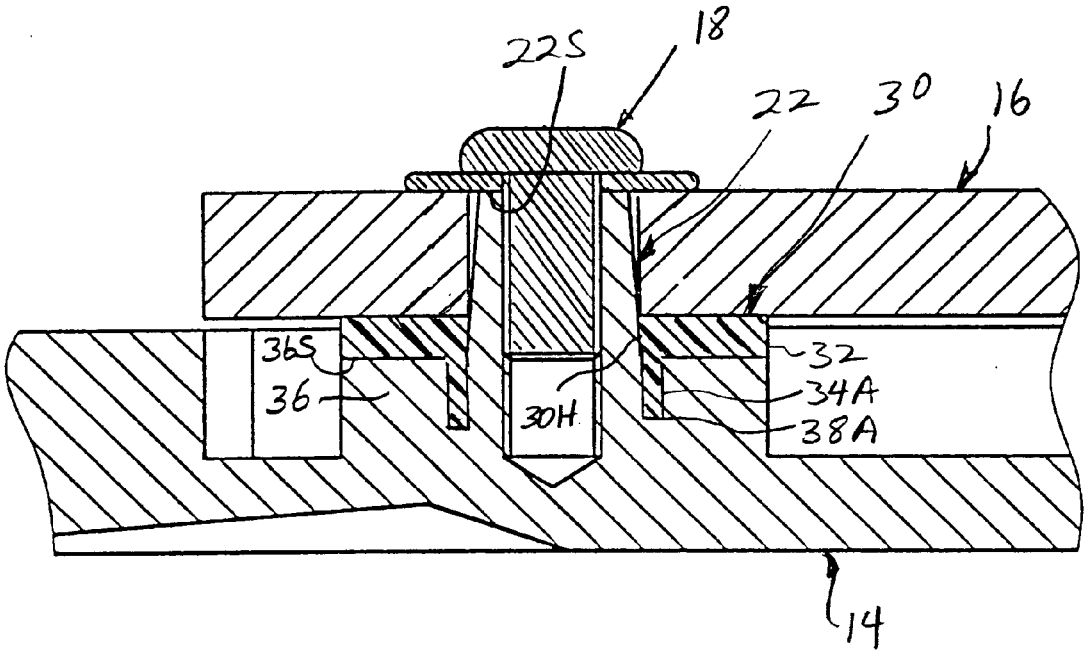
FIG. 4 is a cross-sectional view of a fan blade bracket having the washer of the invention installed therein wherein the washer includes a downwardly extending inner skirt that fits into an annular cavity formed in the boss.
Figure 5:
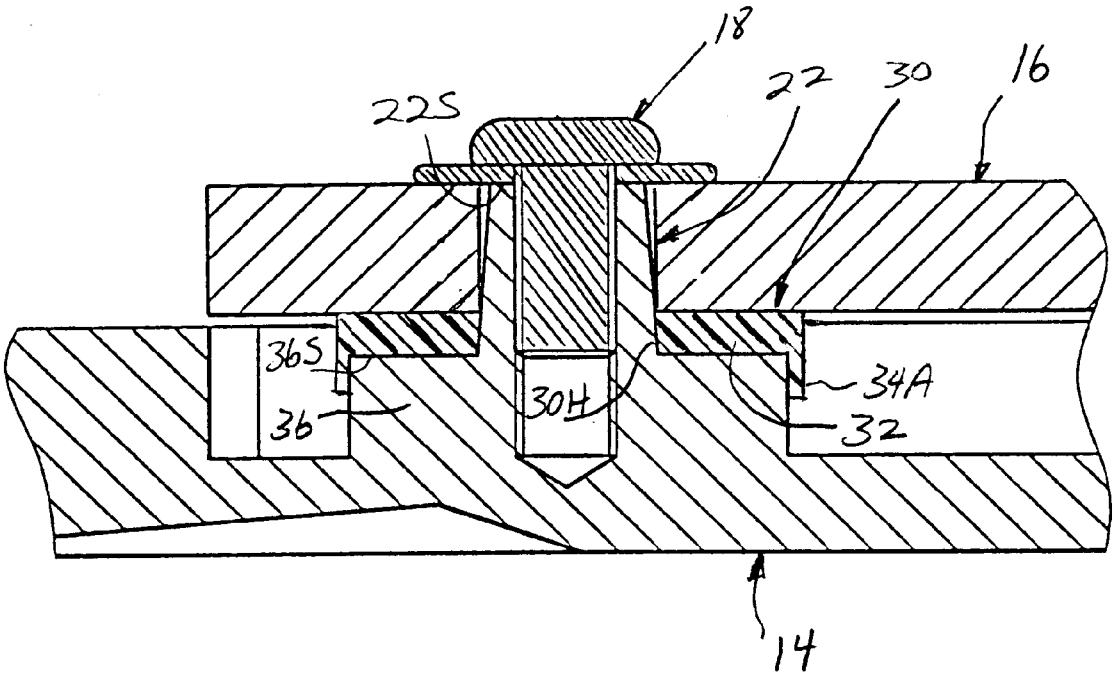
FIG. 5 is a cross-sectional view of a fan blade bracket having the washer of the invention installed therein wherein the washer comprises a downwardly extending outer annular skirt that encompasses the outer periphery of the boss.

The washer 30 of the subject invention, as best illustrated in FIGS. 2 & 3, comprises a generally annular configuration having a flat upper portion 32 and may also include a depending skirt portion 34 formed either on the central, inner or outer edge of the flat upper portion 32 (see FIGS. 3, 4 and 5, respectively). The upper portion 32 preferably includes a diameter approximately equal to the diameter of the upper outside surface 36S of a stepped rim portion 36 encircling the boss 22 and, combined with the thickness of the fan blade 16, preferably has a thickness, that is slightly greater than the distance between the upper outside surface 36S of the stepped rim portion 36 and the upper surface 22S of the boss 22. The boss 22 is preferably frustro-conical in configuration and, preferably, the inner diameter of the hole 30H is slightly less than the lowermost diameter of the boss 22 so that it can be press-fitted thereon and not fall off.

The optional depending skirt portion 34 of the washer 30 of the invention may comprise one or more central protrusions 34P that engage one or more holes or recesses 38P in the boss (see FIG. 3), but may also or alternatively comprise a generally thin annular configuration 34A. The inner version of the skirt 34 as shown in FIG. 4 is configured to fit into a corresponding annular recess 38A formed between the stepped rim portion 36 and the boss 22. Preferably, the thickness of the skirt portion 34 is appreciably greater than the width of the recess 36 such that it must be forcibly inserted therein and held. The outer version of the skirt 34A as shown in FIG. 5 is configured and dimensioned to fit tightly around the outer periphery of the stepped rim portion 36 to be held thereby. With the washer 30 being composed of an elastomeric material with or without the skirt portion 34A, the compression of the washer 30 around the boss 22 holds the washer 30 into place on the boss 22 after assembly. This allows the washer 30 to be pre-assembled at the factory. In this manner, the pre-assembled washers 30 need not be separately assembled by the installing consumer.

During installation by the consumer, the holes 20 of the fan blade 16 are aligned with the respective bosses 22 of the fan blade bracket 10. The large-headed threaded fasteners 18 are then inserted into the holes 20 and threaded into the bosses 22. Upon tightening of the fasteners 18, the flat upper portions 32 of the washers 30 are compressed. It is noted that the relative distance between the upper surface 36S of the rim portion 36 and the upper surface 22S of the bosses 22, together with the over-thickness of the washers 30, causes significant compression of the washers 30, but not over-compression, during tightening of the threaded fasteners 18 before the heads of the fasteners 18 bottom-out on the upper surface 22S of the bosses 22. This unique design therefore provides optimal damping of the fan blades 16 while precluding over-compression of the washer 30 as might otherwise occur if the heads of the fasteners 18 did not bottom-out onto the upper surface 22S of the bosses 22 during tightening. Further, this design may eliminate the need for lock-washers as used in the prior art.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A ceiling fan, comprising in combination:

at least one fan blade;

at least one fan blade bracket for connection to a rotatable motor of the ceiling fan;

said fan blade having at least one hole for receiving a fastener therethrough;

said fan blade bracket having at least one boss for receiving said fastener;

a washer having a hole positioned around said boss between said fan blade bracket and said fan blade; and said boss further including a rim portion onto which said washer is seated, whereby said washer may be affixed into position about said boss prior to installation of said fastener.

2. The ceiling fan as set forth in claim 1, wherein said washer further includes a depending skirt portion.

3. The ceiling fan as set forth in claim 2, wherein said rim portion of said boss further includes a recess formed therein for receiving said skirt portion.

4. The ceiling fan as set forth in claim 3, wherein said recess comprises an annular configuration and said skirt portion comprises an annular configuration encircling said boss.

5. The ceiling fan as set forth in claim 3, wherein said recess comprises one or more holes and wherein said skirt portion comprises one or more respective protrusions extending in said holes.

6. The ceiling fan as set forth in claim 3, wherein said insertion of said skirt portion into said recess comprises compressive insertion.

7. The ceiling fan as set forth in claim 2 wherein said skirt portion comprises an annular configuration that fits around an outer periphery of said rim portion of said boss.

8. The ceiling fan as set forth in claim 7, wherein the distance between an upper portion of said rim portion and an upper portion of said boss is less than the combined thickness of said washer and said fan blade such that compression of the washer occurs during tightening of said threaded fastener into said boss.

9. The ceiling fan as set forth in claim 1, wherein a diameter of said washer is approximately equal to a diameter of said rim portion.

10. The ceiling fan as set forth in claim 1, wherein said washer is composed of an elastomeric material.

11. The ceiling fan as set forth in claim 1, wherein said boss comprises a frustro-conical configuration.

12. The ceiling fan as set forth in claim 11, wherein said fastener comprises a large-headed threaded fastener and said hole comprises a diameter that is slightly less than a diameter of said boss.

* * * * *